US006419339B2

(12) United States Patent
Takahashi

(10) Patent No.: US 6,419,339 B2
(45) Date of Patent: Jul. 16, 2002

(54) INK JET RECORDING METHOD AND INK JET RECORDER FOR EJECTING CONTROLLED INK DROPLETS

(75) Inventor: Yoshikazu Takahashi, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 09/811,489

(22) Filed: Mar. 20, 2001

(30) Foreign Application Priority Data

Mar. 31, 2000 (JP) ..... 2000-097538

(51) Int. Cl.[7] ..... B41J 29/38
(52) U.S. Cl. ..... 347/14; 347/11
(58) Field of Search ..... 347/14, 10, 11, 347/57

(56) References Cited

U.S. PATENT DOCUMENTS 5,369,428 A * 11/1994 Maze et al. ..... 347/5
5,475,800 A * 12/1995 Vaughn et al. ..... 358/518
5,661,507 A * 8/1997 Sperry ..... 347/9

* cited by examiner

*Primary Examiner*—Thinh Nguyen
(74) *Attorney, Agent, or Firm*—Oliff & Berridge, PLC

(57) ABSTRACT

Serial dots are printed with a drive waveform 1 for section of four ink droplets per dot from a nozzle. If one print instruction for a dot immediately follows and immediately precedes no others, a drive waveform 2 for ejection of less than four ink droplets per dot from a nozzle is selected for stable printing even under a condition where, if the drive waveform 1 were used, the ink droplets might be ejected in wrong directions, and/or useless ink droplets might be ejected.

22 Claims, 10 Drawing Sheets

Fig. 2A

| JUST BEFORE | JUST AFTER | CONDITION OF DRIVE WAVEFORM |
|---|---|---|
| EJECTION | EJECTION | DRIVE WAVEFORM 1 |
| EJECTION | NO EJECTION | DRIVE WAVEFORM 1 |
| NO EJECTION | EJECTION | DRIVE WAVEFORM 1 |
| NO EJECTION | NO EJECTION | DRIVE WAVEFORM 2 |

Fig. 2B

| JUST BEFORE | JUST AFTER | CONDITION OF DRIVE WAVEFORM |
|---|---|---|
| EJECTION | EJECTION | DRIVE WAVEFORM 1 |
| EJECTION | NO EJECTION | DRIVE WAVEFORM 2 |
| NO EJECTION | EJECTION | DRIVE WAVEFORM 2 |
| NO EJECTION | NO EJECTION | DRIVE WAVEFORM 2 |

Fig. 4

| JUST BEFORE | JUST AFTER | CONDITION OF DRIVE WAVEFORM |
|---|---|---|
| EJECTION | EJECTION | DRIVE WAVEFORM 1 |
| EJECTION | NO EJECTION | DRIVE WAVEFORM 1 |
| NO EJECTION | EJECTION | DRIVE WAVEFORM 1 |
| NO EJECTION | NO EJECTION | DRIVE WAVEFORM 1 |

INK JET RECORDING METHOD AND INK JET RECORDER FOR EJECTING CONTROLLED INK DROPLETS

BACKGROUND OF THE INVENTION

1. Field of the Invention

The present invention relates to an ink jet recording method and an ink jet recorder, and specifically an ink jet recording method and an ink jet recorder which can control a number of ink droplets for forming a dot, and a storage medium for storing a program for driving the recorder.

2. Description of the Related Art

A known conventional ink ejector of the ink jet type has ink channels and nozzles each communicating with one of the channels. The volume of each ink channel can be changed by the deformation of a piezoelectric ceramic or the like. When the channel volume decreases, ink in the ink channel is ejected as droplets through the associated nozzle. When the channel volume increases, the ink channel is supplied with ink from an ink supply.

Such a conventional ink ejector 600 is shown in section in FIG. 6 of the accompanying drawings. The ink ejector 600 includes an actuator substrate 601 and a cover plate 602. The actuator substrate 601 has ink channels 613 and spaces 615 all in the form of grooves, which extend perpendicularly to a record medium set on the recorder including the ejector 600. The ink channels 613 and spaces 615 are arrayed alternately, with side walls 617 interposed between them, which are made of piezoelectric material. Each side wall 617 consists of a lower wall 611 and an upper wall 609, which are polarized in opposite directions P1 and P2, respectively. Each ink channel 613 has a nozzle 618 formed at one end. The other ends of the ink channels 613 are connected to a manifold (not shown), through which ink can be supplied. Those ends of the spaces 615 which are adjacent to the manifold are closed so that no ink can enter the spaces.

Both sides of each side wall 617 are fitted with a pair of electrodes 619 and 621 in the form of metallized layers. Specifically, the electrodes 619 and 621 are a channel electrode 619 and a space electrode 621, which are positioned in the adjacent ink channel 613 and space 615, respectively. All the channel electrodes 619 are grounded. The space electrodes 621 are connected to a controller 625 (FIG. 8), which outputs actuator drive signals. The space electrodes 621 on both sides of each ink channel 613 are connected together. The space electrodes 621 in each space 615 are insulated from each other.

When voltage is applied to the space electrodes 621 on both sides of any of the ink channels 613, the associated side walls 617 deform piezoelectrically in such directions that the channel or channels 613 enlarge in volume. As shown in FIG. 7 of the drawings, for example, in order to drive the side walls 617*c* and 617*d* for the ink channel 613*b*, a voltage of E volts is applied to the associated space electrodes 621*c* and 621*d*. The voltage application generates electric fields in opposite directions E in the side walls 617*c* and 617*d*. The electric fields deform the side walls 617*c* and 617*d* piezoelectrically in such directions that the ink channel 613*b* enlarges in volume, reducing the pressure in this channel 613*b*. This condition is maintained for the one-way propagation time T of a pressure wave in each ink channel 613. This supplies ink from the manifold to the ink channel 613*b* during the propagation time T.

The one-way propagation time T is the time that it takes for a pressure wave in each ink channel 613 to be propagated longitudinally of the channel 613. This propagation time T is L/a (T=L/a) where L is the length of the ink channel 613 and a is the sound velocity in the ink in the channel 613.

According to the theory of pressure wave propagation, exactly when the time T passes after the voltage is applied to the space electrodes 621*c* and 621*d*, the pressure in the ink channel 613*b* reverses into a positive pressure. When the pressure becomes positive, the voltage is returned to 0 volt. This allows the deformed side walls 617*c* and 617*d* to return to their original condition (FIG. 6) so as to apply a positive pressure to the ink in the ink channel 613*b*. This pressure is added to the pressure which has reversed to be positive. As a result, a relatively high pressure develops in that portion of the inkchannel 613*b* which is near to the nozzle 618*b*, ejecting an ink droplet through the nozzle.

If the period after the voltage is applied and until it is returned to 0 volt differs from the one-way propagation time T, the energy efficiency for the droplet ejection lowers. If this period is roughly an even number of times the propagation time T, no ink is ejected. Therefore, in general, in order to raise the energy efficiency, for example, to drive the side walls 617 at a voltage as low as possible, it is preferable that the period be roughly equal to the propagation time T or at least roughly an odd number of times the time T.

After an ink droplet is ejected from one of the ink channels 613 in accordance with a print instruction, vibration remains on the meniscus of ink in the associated nozzle 618. At some drive frequencies, the vibration affects the ejection of an ink droplet in accordance with the next print instruction. For example, the vibration may cause the ink droplet to be ejected in a wrong direction, or a needless ink droplet to be ejected.

FIG. 5 of the drawings shows printing with ink droplets ejected from one of the ink channels 613 in accordance with different patterns of print instructions at a higher drive frequency for printing at a higher speed. In accordance with the consecutive or serial print instructions, ink droplets can be ejected stably. In accordance with the print instruction for every other drive cycle (dot), that is a pair of print instruction and non-print instruction is repeated however, the influence of the ink meniscus in the associated nozzle 618 is amplified. This is liable to make ink droplets ejected in wrong directions and/or needless ink droplets ejected.

SUMMARY OF THE INVENTION

It is an object of the present invention to provide an ink jet recording method for good recording quality, which makes it possible to stably eject ink by changing the number of ejected ink droplets for a dot if the print instruction for the dot immediately follows and/or immediately precedes non-print instruction. It is another object to provide an ink jet recorder and a storage medium for use with such a recording method.

In accordance with a first aspect of the present invention, an ink jet recording method is provided for recording a dot pattern on a record medium by means of a recorder including an actuator, which has an ink channel filled with ink and a nozzle communicating with the ink channel. The ink channel can change in volume to eject ink from it through the nozzle. The recording method includes the steps of:

judging whether one print instruction for forming a dot immediately follows another or not and whether the one print instruction immediately precedes another or not; and causing the actuator to eject a predetermined number of ink droplets for forming the dot depending on the result of the judgment.

The recording method makes it possible to stably eject ink, regardless of whether one print instruction for forming a dot immediately follows another or not, and regardless of whether the one print instruction immediately precedes another or not.

If the one print instruction for forming the dot immediately follows another and immediately precedes another, the predetermined number of ink droplets for forming the dot may be N which is two or more ($N \geqq 2$). The number N may be three or four. If the one print instruction immediately follows and immediately precedes no others, the number of ink droplets may be M which is smaller than N ($M<N$). As vibration remained on the meniscus of ink in the nozzle increases, a number of ejections increases because the vibration corresponds to vibration in pressure which is accumulated thereto each time an ink droplet is ejected from the nozzle. Accordingly, if the number M of ink droplets is smaller than N ($M<N$), the vibration can be reduced.

If the one print instruction immediately follows or immediately precedes no other when the temperature of the ink or the ambient temperature around the ink is lower than a predetermined temperature, the predetermined number of ink droplets may be N ($N \geqq 2$). If the one print instruction immediately follows or immediately precedes no other when the ink temperature or the ambient temperature is equal to or higher than the predetermined temperature, the number of ink droplets may be M ($M<N$).

By reducing the number of ink droplets, it is possible to restrain the influence of the residual vibration of the ink meniscus in the nozzle to stably eject the droplets. Even if the viscosity of the ink changes with temperature, it is possible to keep the ejection stable.

The number M may be N minus one ($M=N-1$). In this case, if the one print instruction immediately follows and/or immediately precedes no other, one or more ink droplets which are only one fewer than the number N are ejected for the dot. This makes it possible to restrain the influence of the residual vibration of the ink meniscus in the nozzle, and to stably eject the ink droplets similar in total volume to those for serial printing.

In accordance with a second aspect of the present invention, an ink jet recorder is provided. The recorder includes an actuator having an ink channel which can be filled with ink and a nozzle communicating with the ink channel. The ink channel can change in volume to eject ink from it through the nozzle to record a dot pattern on a record medium. The recorder also includes a judgment device for judging whether one print instruction for forming a dot immediately follows another or not and whether the one print instruction immediately precedes another or not. The judgment device may be a circuit for driving the actuator. The recorder also includes a driver for driving the actuator to eject from the actuator for forming the dot a predetermined number of ink droplets depending on the result of the judgment.

The recorder may further include a storage device storing in it the relationship between the predetermined number of ejected ink droplets or ejection waveform and the presence/absence of print instructions immediately preceding and immediately following the one print instruction.

If the judgment device judges that the one print instruction immediately follows another and immediately precedes another, the driver may drive the actuator to eject a number N of ink droplets which are at least two ($N \geqq 2$). The number N may be three or four. If the judgment device judges that the one print instruction immediately follows and immediately precedes no others, the driver may drive the actuator to eject a number M of ink droplets fewer than the number N ($M<N$). The number M may be N minus one ($M=N-1$).

By reducing the number of ink droplets, it is possible to restrain the influence of the residual vibration of the ink meniscus in the nozzle to stably eject the droplets.

The recorder may further include a temperature sensor for measuring the temperature of the ink or the ambient temperature around the ink. If the one print instruction immediately follows or immediately precedes no other when the measured temperature is lower than a predetermined temperature, the actuator may eject ink droplets which are N ($N \geqq 2$) in number. If the one print instruction immediately follows or immediately precedes no other when the measured temperature is equal to or higher than the predetermined temperature, the actuator may eject ink droplets which are M ($M<N$) in number. This makes it possible to keep the ejection stable even if the viscosity of the ink changes with temperature.

In accordance with a third aspect of the present invention, a storage medium is provided which stores in it a program for use with an ink jet recorder including an actuator. The actuator has an ink channel which can be filled with ink and a nozzle communicating with the ink channel. The program drives the actuator so that the ink channel changes in volume to eject ink from it through the nozzle to record a dot pattern on a record medium. The program includes the steps of:

judging whether one print instruction for forming a dot immediately follows another or not and whether the one print instruction immediately precedes another or not; and controlling the actuator to eject from the actuator a predetermined number of ink droplets for forming the dot depending on the result of the judgment.

The program may further include the steps of:

selecting, as the predetermined number of ink droplets for forming the dot, a number N if the one print instruction immediately follows another and immediately precedes another, the number N being at least two ($N \geqq 2$); and selecting, as the predetermined number of ink droplets for forming the dot, a number M if the one print instruction immediately follows and immediately precedes no others, the number M being smaller than the number N ($M<N$).

The number N may be three or four. The number M may be N minus one ($M=N-1$).

The program may further include the step of selecting, as the number of ink droplets for forming the dot, the number N ($N \geqq 2$) if the one print instruction immediately follows or immediately precedes no other.

The program may include the step of selecting, as the number of ink droplets for forming the dot, the number M ($M<N$) depending on the temperature of the ink or the ambient temperature around the ink if the one print instruction immediately follows or immediately precedes no other.

The program may be driver software for controlling a driver circuit for the actuator.

The storage medium may have data stored in it on different waveforms for the actuator.

BRIEF DESCRIPTION OF THE DRAWINGS

Preferred embodiments of the present invention are shown in the accompanying drawings, in which:

FIGS. 2A and 2B are charts showing conditions for selecting one of the drive waveforms embodying the invention;

FIG. 4 is a chart showing conditions for selecting a conventional drive waveform;

DETAILED DESCRIPTION OF THE PREFERRED EMBODIMENTS

Figure 6:
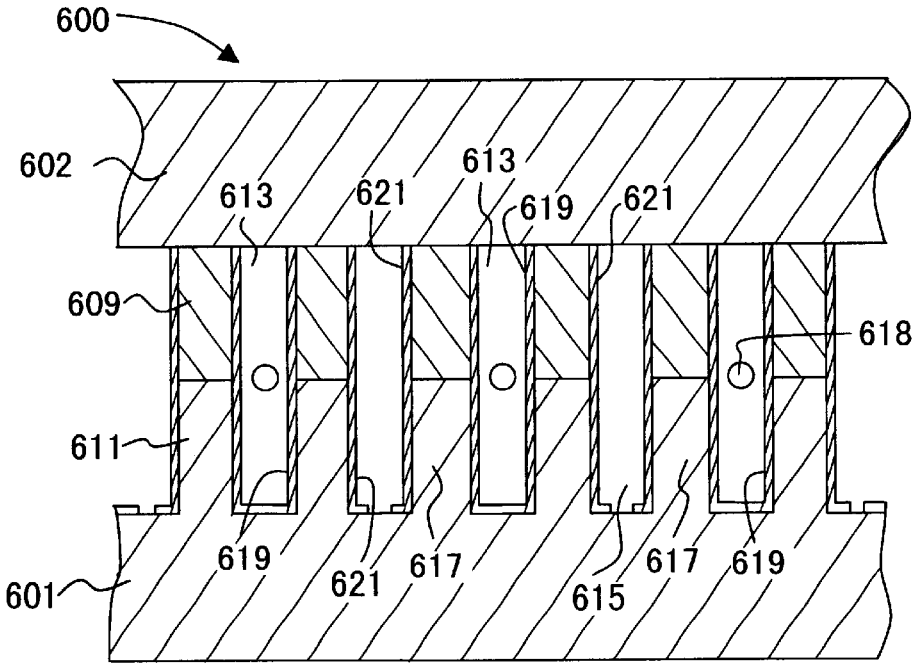
FIGS. 6 and 7 are cross sections of an ink ejector embodying the invention.

An ink droplet ejector embodying the present invention is similar in mechanical structure to that shown in FIG. 6, and will therefore not be described.

An embodiment of the ink droplet ejector 600 was tested. Each ink channel 613 of the ejector had a length L of 6.0 mm. Each nozzle 618 of the ejector had a length of 75 μm, a diameter of 26 μm on its outer side for ejection of ink, and a diameter of 40 μm on its inner side adjacent to the associated channel 613. The ink used for the test had a viscosity of about 2 mPa·s and a surface tension of 30 mN/m at a temperature of 25° C. The ratio L/a (=T) of the length L to the sound velocity a in the ink in each ink channel 613 was 9.0 μsec.

Figure 1A:
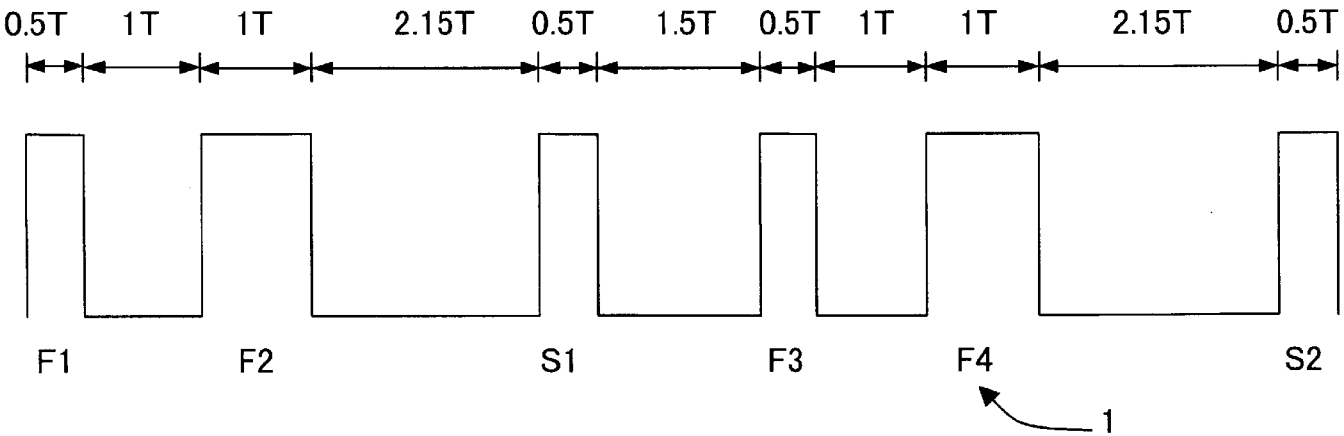
FIGS. 1A and 1B are charts showing drive waveforms embodying the invention.

FIG. 1A shows a drive waveform 1 for normally ejecting four ink droplets at different times from one of the ink channels 613 in accordance with a print instruction for one dot. The drive waveform 1 includes ejection pulses F1, F2, F3 and F4 and ejection stabilization pulses S1 and S2. The ejection pulses F1–F4 are applied to eject the ink droplets. The stabilization pulses S1 and S2 are applied to reduce the residual pressure wave vibration in the ink channel 613 without ejecting ink. All the pulses F1–F4, S1 and S2 have a crest value (voltage) of E volts (for example, 16 volts at 25° C.).

The width of the ejection pulse F1 is 0.5T (T is the one-way propagation time of a pressure wave in each ink channel 613). This pulse width for the ink ejector (T=L/a=9 μsec) was 4.5 μsec. The interval between the ejection pulses F1 and F2 is equal to T. This pulse interval for the ejector was 9 μsec. The width of the ejection pulse F2 equals T. This pulse width for the ejector was 9 μsec. The interval between the ejection pulse F2 and the stabilization pulse S1 is 2.15T. This pulse interval for the ejector was 19.35 μsec. The width of the stabilization pulse S1 is 0.5T. This pulse width for the ejector was 4.5 μsec. The interval between the stabilization pulse S1 and the ejection pulse F3 is 1.5T. This pulse interval for the ejector was 13.5 μsec. The width of the ejection pulse F3 is 0.5T. This pulse width for the ejector was 4.5 μsec. The interval between the ejection pulses F3 and F4 equals T. This pulse interval for the ejector was 9 μsec. The width of the ejection pulse F4 equals T. This pulse width for the ejector was 9 μsec. The interval between the ejection pulse F4 and the stabilization pulse S2 is 2.15T. This pulse interval for the ejector was 19.35 μsec. The width of the stabilization pulse S2 is 0.5T. This pulse width for the ejector was 4.5 μsec.

These pulse intervals (timing) and widths make it possible to control the volume and stability of the ink droplets. The drive waveform 1 is applied to eject a series of two ink droplets from one of the ink channels 613 with the ejection pulses F1 and F2, restraining the residual pressure wave vibration in the ink channel 613 with the stabilization pulse S1, ejecting another series of two ink droplets from the channel 613 with. the ejection pulses F3 and F4, and restraining the vibration of ink near the associated nozzle 69 with the stabilization pulse S2. Thus, four ink droplets in total are ejected in accordance with a print instruction for one dot. This achieves the total ink volume of about 60 pl necessary for printing one dot at a resolution on the order of 300×300 dpi. The four serial ink droplets reach a record medium or the like, where they join together and form an oval dot slightly longer in the scanning direction of the ink ejector 600. The pulse intervals and widths were found out experimentally for stable ejection of ink without splashes at frequencies between 5 and 8.5 kHz from a low temperature of 5° C. to a high temperature of 45° C.

Figure 5:
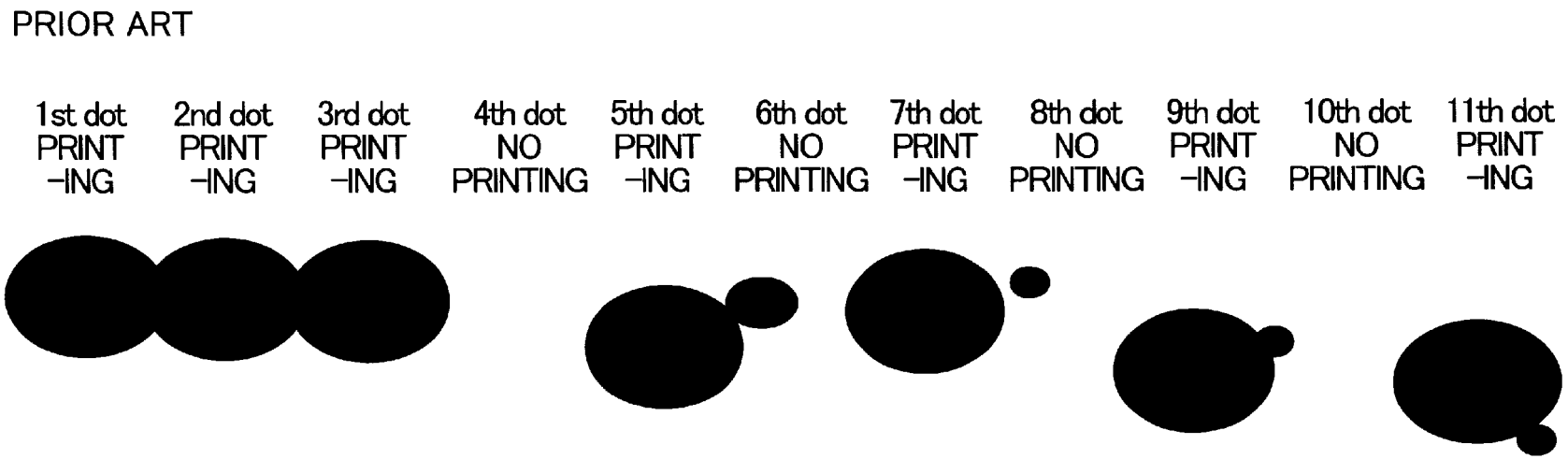
Fig. 5 PRIOR ART
FIG. 5 is a chart showing results of printing with the conventional drive waveform.

FIG. 4 shows various print patterns for three drive cycles. For each print pattern, only the drive waveform 1 is used for printing in accordance with each print instruction whether the instruction immediately succeeds another print instruction or not and whether it immediately precedes another print instruction or not. FIG. 5 shows results of the printing with ink droplets ejected from one of the ink channels 613 with the drive waveform 1. As shown in FIG. 5 in particular the 2nd dot, the consecutive print instructions cause ink droplets to be ejected stably onto a record medium. In accordance with the print instruction for every other drive cycle, as also shown in FIG. 5 in particular the 6th, 8th and 10th dots ink droplets may be ejected in wrong directions onto wrong spots, and/or needless ink droplets may be ejected. This is conceived to be due to the greater residual pressure vibration in the ink channel 613 after the ejection of ink in accordance with the print instruction for every other drive cycle than in accordance with one print instruction immediately succeeding another.

Figure 1B:
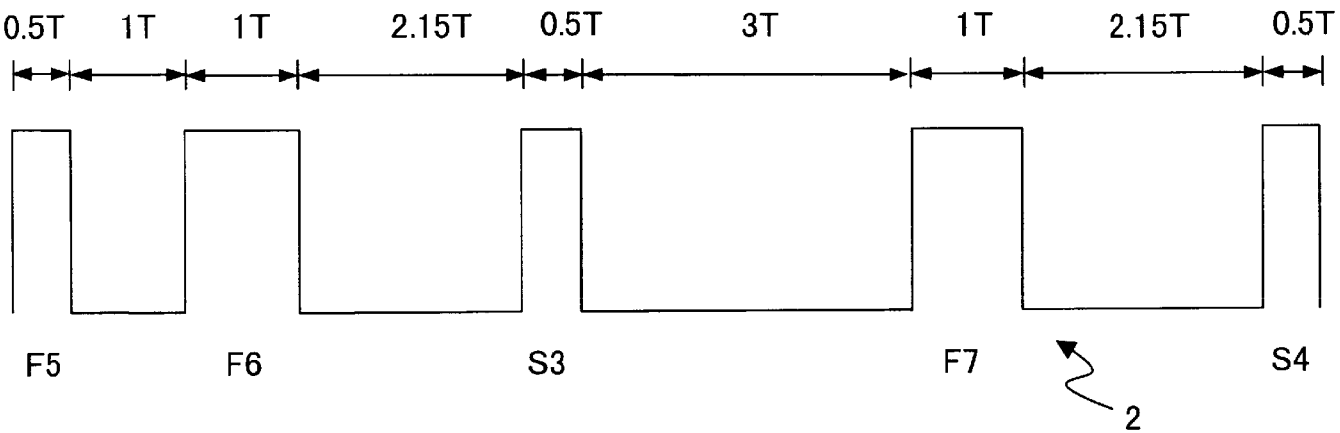

FIG. 1B shows a drive waveform 2 for ejecting three ink droplets from one of the ink channels 613 in accordance with a print instruction for one dot. The drive waveform 2 is adapted for ejection of fewer ink droplets than the drive waveform 1 in order to eject the droplets stably even under the influence of the residual pressure wave vibration in the ink channel 613 before the ejection. As the number of ejected droplets decreases, the stability of droplet ejection is improved. If the drive waveform 2 were adapted to eject too few ink droplets, however, the difference in total ejected ink volume between the waveforms 1 and 2 would be too large. Accordingly, the drive waveform 2 is adapted to eject one fewer ink droplets than the waveform 1.

The drive waveform 2 includes ejection pulses F5, F6 and F7 and ejection stabilization pulses S3 and S4. The ejection pulses F5–F7 are applied to eject the ink droplets. The stabilization pulses S3 and S4 are applied to reduce the residual pressure wave vibration in the ink channel 613 without ejecting ink. All the pulses F5–F7, S3 and S4 have a crest value (voltage) of E volts (for example, 16 volts at 25° C.).

The width of the ejection pulse F5 is 0.5T (T is the one-way propagation time of a pressure wave in each ink channel 613). This pulse width for the ink ejector (T=L/a=9 μsec) was 4.5 μsec. The interval between the ejection pulses F5 and F6 equals T. This pulse interval for the ejector was 9 μsec. The width of the ejection pulse F6 equals T. This pulse width for the ejector was 9 μsec. The interval between the ejection pulse F6 and the stabilization pulse S3 is 2.15T. This pulse interval for the ejector was 19.35 μsec. The width of the stabilization pulse S3 is 0.5T. This pulse width for the ejector was 4.5 μsec. The interval between the stabilization pulse S3 and the ejection pulse F7 is 3T. This pulse interval for the ejector was 27.0 μsec. The width of the ejection pulse F7 equals T. This pulse width for the ejector was 9 μsec. The interval between the ejection pulse F7 and the stabilization pulse S4 is 2.15T. This pulse interval for the ejector was 19.35 μsec. The width of the stabilization pulse S4 is 0.5T. This pulse width for the ejector was 4.5 μsec.

These pulse intervals and widths make it possible to control the volume and stability of the ink droplets. The drive waveform 2 is applied to eject a series of two ink droplets from one of the ink channels 613 with the ejection pulses F5 and F6, restraining the residual pressure wave vibration in the ink channel 613 with the stabilization pulse S3, ejecting another ink droplet from the channel 613 with the ejection pulse F7, and restraining the vibration of ink near the associated nozzle 618 with the stabilization pulse S4. Thus, three ink droplets in total are ejected in accordance with a print instruction for one dot. This achieves a total ink volume of about 45 pl. The pulse intervals and widths were found out experimentally for stable ejection of ink without splashes at frequencies between 2.5 and 8.5 kHz from a low temperature of 5° C. to a high temperature of 45° C.

FIGS. 2A and 2B show various patterns of ejection of ink droplets for three drive cycles with the drive waveform 1 or 2 selected depending on whether one print instruction immediately succeeds another and whether it immediately precedes another.

The ejection patterns shown in FIG. 2A include three normal patterns of ejection of four ink droplets per dot with the drive waveform 1. The patterns of FIG. 2A also include a pattern of ejection of three ink droplets per dot with the drive waveform 2 in accordance with one print instruction immediately succeeding and preceding no others. This makes it possible to do stable printing under all conditions, because the more stable drive waveform 2 is used in the case of a print instruction being given for every other drive cycle. In this particular case, if the waveform 1 were used, ink droplets might be ejected in wrong directions onto wrong spots, and/or needless ink droplets might be ejected.

Figure 3A:
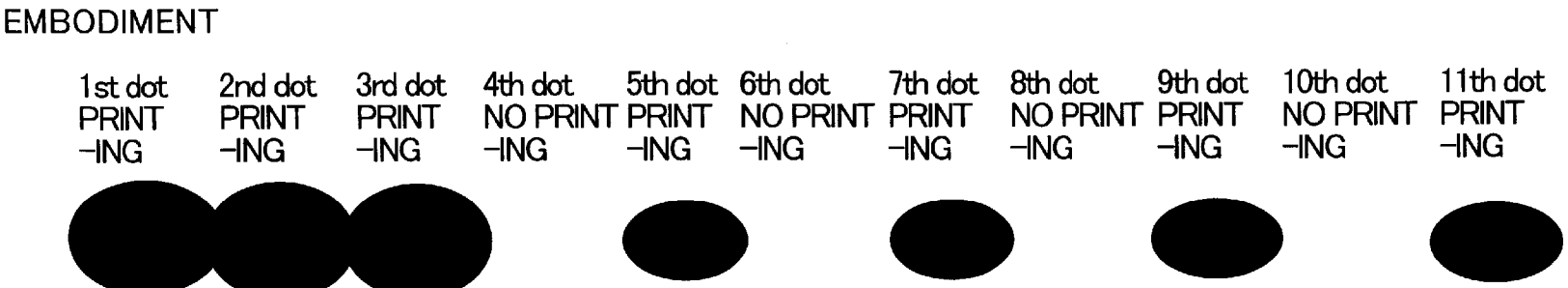
FIGS. 3A and 3B are charts showing results of printing with the drive waveforms embodying the invention.

FIG. 3A shows the print results. For the consecutive or serial dots, as shown in FIG. 3A, the use of the drive waveform 1 makes it possible to print them with ink in the amounts necessary for thick or sufficient printing. In such cases that a print instruction is given for every other drive cycle, as also shown in FIG. 3A (for example, 5th, 7th and 9th dots), the use of the waveform 2 makes it possible to do good printing without ink droplets ejected onto wrong spots and without needless ink droplets ejected, though the amount of ejected ink decreases slightly.

FIG. 2B shows the selection of the drive waveform 1 or 2 for ejection of ink droplets from the ink ejector 600 in a higher temperature environment, where the ink is less viscous and consequently the ejection is liable to be more unstable. In this environment, the drive waveform 1 for ejection of four ink droplets per dot is used in the case of one print instruction immediately succeeding and preceding others, while the drive waveform 2 for ejection of fewer ink droplets per dot is used in the case of one print instruction immediately succeeding and/or preceding no others. This makes it possible to do stable printing under all conditions, because the more stable drive waveform 2 is used in the case of a print instruction being given for every other drive cycle. In this particular case, if the waveform 1 were used, ink droplets might be ejected in wrong directions onto wrong spots, and/or needless ink droplets might be ejected.

Figure 3B:
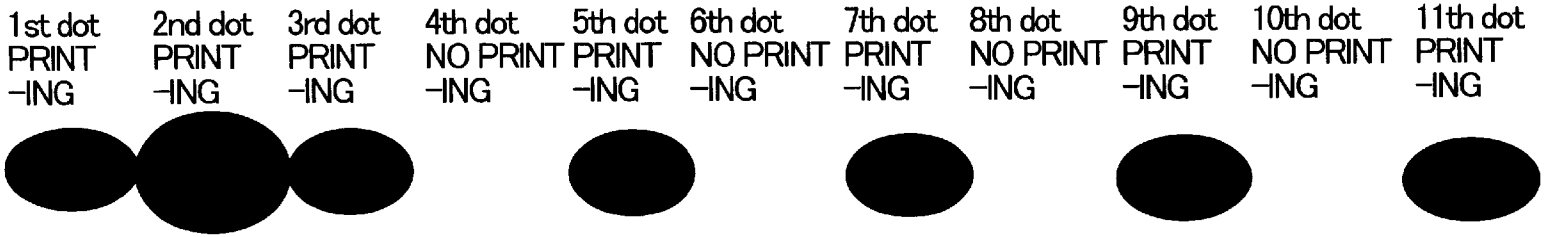

FIG. 3B shows the print results. In accordance with the three consecutive print instructions, as shown in FIG. 3B (for example 1st, 2nd and 3rd dots) the use of the drive waveform 1 for only the middle one (the 2nd dot)of them makes it possible to print them with ink in the amounts necessary for thick or sufficient printing. In the case of one print instruction being given for every other drive cycle, or immediately succeeding or preceding no other, as also shown in FIG. 3B (for example, 5th, 7th and 9th dots), the use of the waveform 2 for this particular instruction makes it possible to do better printing without ink droplets ejected onto wrong spots and without needless ink droplets ejected, though the amount of ejected ink decreases slightly.

As shown in FIG. 1B, the drive waveform 2 is defined as a waveform for ejection of three ink droplets per dot. For good printing, the drive waveform 2 might consist of only the ejection pulses F5 and F6 for ejection of two ink droplets per dot and the stabilization pulse S3, though the volume of ejected ink is even smaller than in the case of the drive waveform 1 being used. Likewise, for good printing, the drive waveform 2 might consist of only the ejection pulse F6 for ejection of one ink droplet per dot and the stabilization pulse S3, though the volume of ejected ink is still smaller than in the case of the drive waveform 1 being used. In order to improve the printing quality with the minimum difference in volume of ejected ink between the drive waveforms 1 and 2, only one fewer ink droplets should preferably be ejected per dot with the waveform 2 than with the waveform 1, as shown in FIG. 1B.

As described in detail, fewer ink droplets are ejected per dot in accordance with one print instruction immediately succeeding and/or preceding no others. This makes it possible to stably eject the ink droplets, improving the printing quality.

Figure 8:
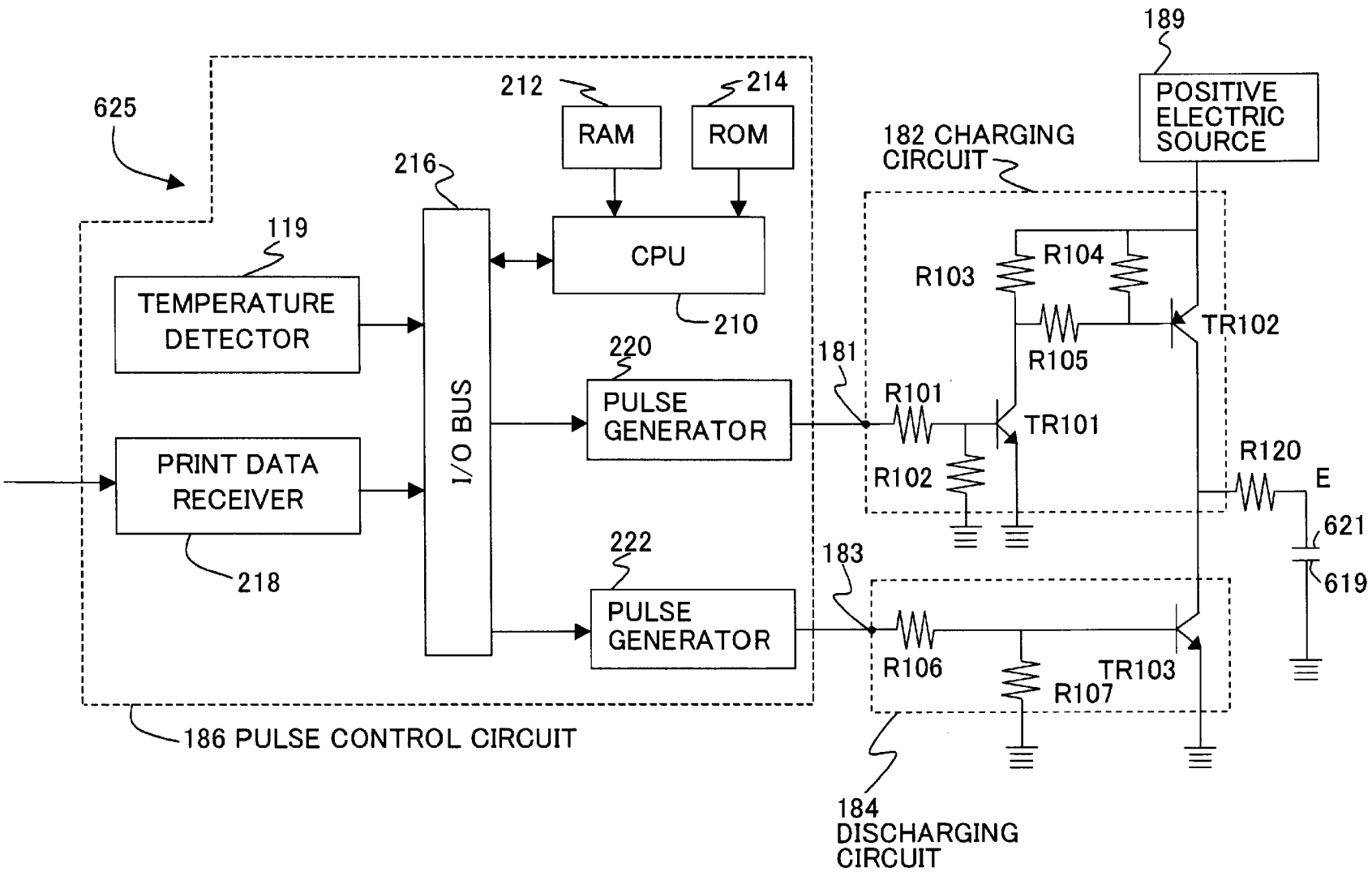
FIG. 8 is a diagramof a control circuit for the ink ejector embodying the invention.
Figure 9:
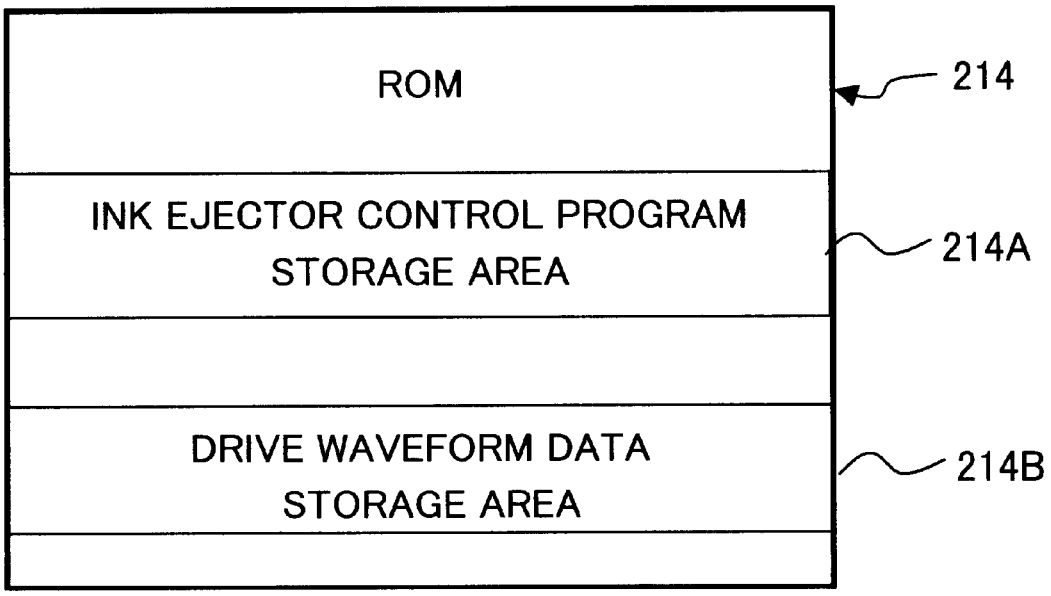
FIG. 9 shows the storage areas of the ROM of the driver for the ink ejector embodying the invention.

FIGS. 8–10 show a driver 625 for realizing the drive waveforms 1 and 2. With reference to FIG. 8, the driver 625 includes a pulse control circuit 186. The driver 625 also includes a charging circuit 182 and a discharging circuit 184 both for each ink channel 613. A capacitor 191 equivalently represents the piezoelectric material for the side walls 617 on both sides of the ink channel 613 and the associated electrodes 619 and 621. Pulse signals can be input through input terminals 181 and 183 to apply voltages of E volts and 0 volt, respectively, to the space electrodes 621 for the ink channel 613.

The charging circuit 182 consists of resistors R101, R102, R103, R104 and R105, and transistors TR101 and TR102. If an ON-signal (+5 volts) is input to the input terminal 181, the transistor TR101 becomes conductive, allowing current to flow from a positive electric source 189 through the resistor R103 and the collector of this transistor to the emitter of the transistor. This raises the voltages applied to the resistor R105 and the resistor R104, which is connected to the electric source 189. Consequently, the current flowing into the base of the transistor TR102 increases, making this transistor conductive between its emitter and collector. As a result, a voltage, which may be 16 volts, is applied from the electric source 189 through the emitter and collector of the transistor TR102 and a resistor R120 to the electrodes 621.

Figure 7:
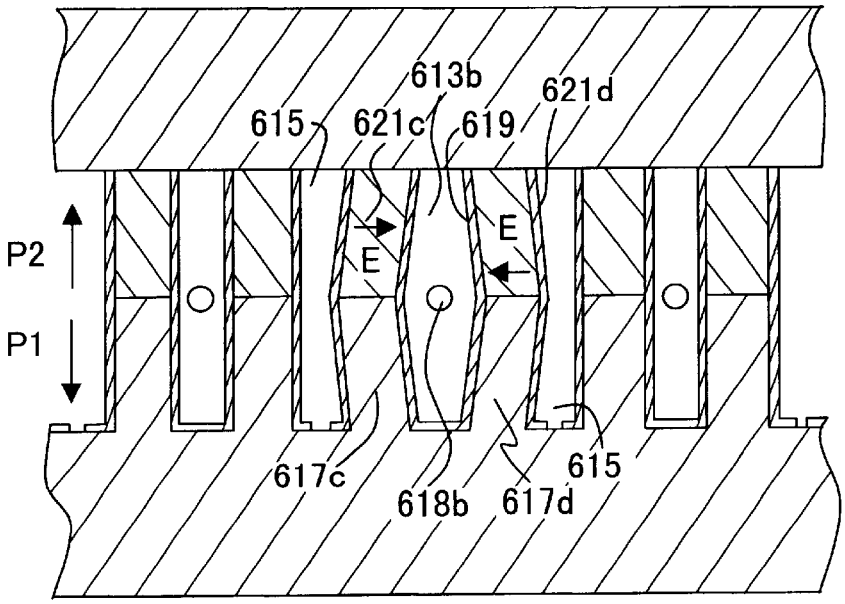

The discharging circuit 184 consists of resistors R106 and R107 and a transistor TR103. If an ON-signal (+5 volts) is input to the input terminal 183, the transistor TR103 becomes conductive, grounding the electrodes 621 through the resistor R120. This discharges the electric charge applied to the side walls 617 (FIGS. 6 and 7).

The pulse control circuit 186 generates pulse signals for inputting to the input terminals 181 and 183 of the charging circuits 182 and discharging circuits 184, respectively. The pulse control circuit 186 includes a CPU 210 for various operations, which is connected to a RAM 212 and a ROM 214. Print data and other data are stored in the RAM 212. Stored in the ROM 214 are a control program for the control circuit 186 and sequence data for generation of ON-signals and OFF-signals at predetermined points of time.

As shown in FIG. 9, the ROM 214 includes an ink droplet ejection control program storage area 214A and a drive waveform data storage area 214B. The sequence data relating to the drive waveforms are stored in the data storage area 214B.

The CPU 210 is connected to an I/O bus 216, via which various data can be input and output. The bus 216 is connected to a temperature detector 119 for detecting the ambient temperature, a print data receiver 218, pulse generators 220 (only one shown) and pulse generators 222 (only one shown). The output terminal of each pulse generator 220 is connected to the input terminal 181 of one of the charging circuits 182. The output terminal of each pulse generator 222 is connected to the input terminal 183 of one of the discharging circuits 184.

The CPU 210 controls the pulse generators 220 and 222 in accordance with the sequence data stored in the drive waveform data storage area 214B of the ROM 214. Accordingly, by storing the drive waveforms 1 and 2 in advance in the storage area 214B, it is possible to selectively apply the drive pulses of the drive waveform 1 or 2 to the appropriate actuator walls 617. On the basis of the temperature detected by the temperature detector 119, it is also possible to select drive waveform data in accordance with the sequence data stored in the storage area 214B.

Figure 10A:
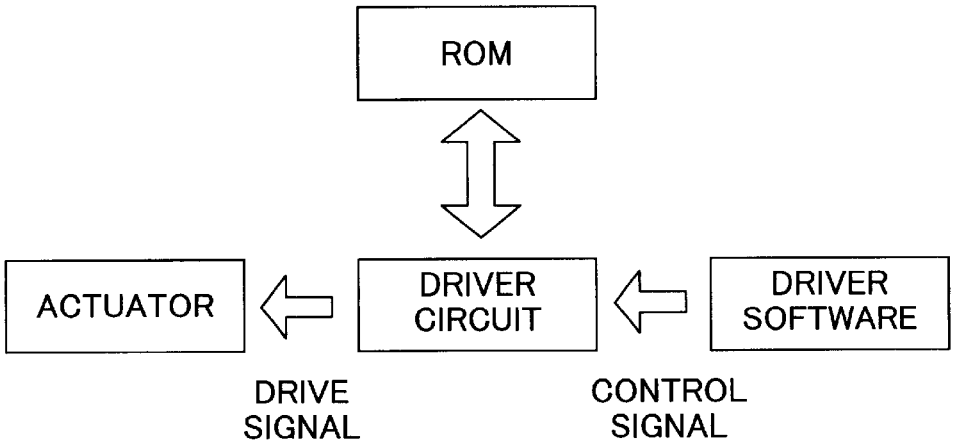
FIGS. 10A and 10B are functional block diagrams of the driver.
Figure 10B:
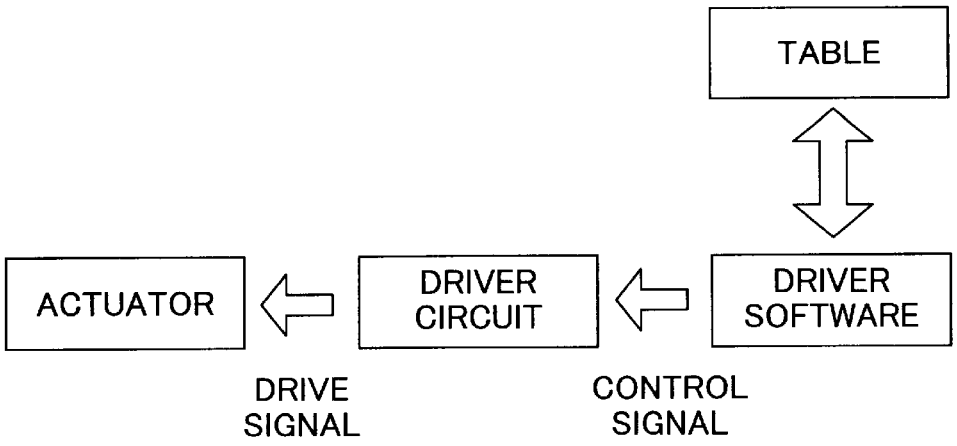

FIGS. 10A and 10B are functional block diagrams of the driver 625, and show the flow of the print instruction signals.

Figure 11:
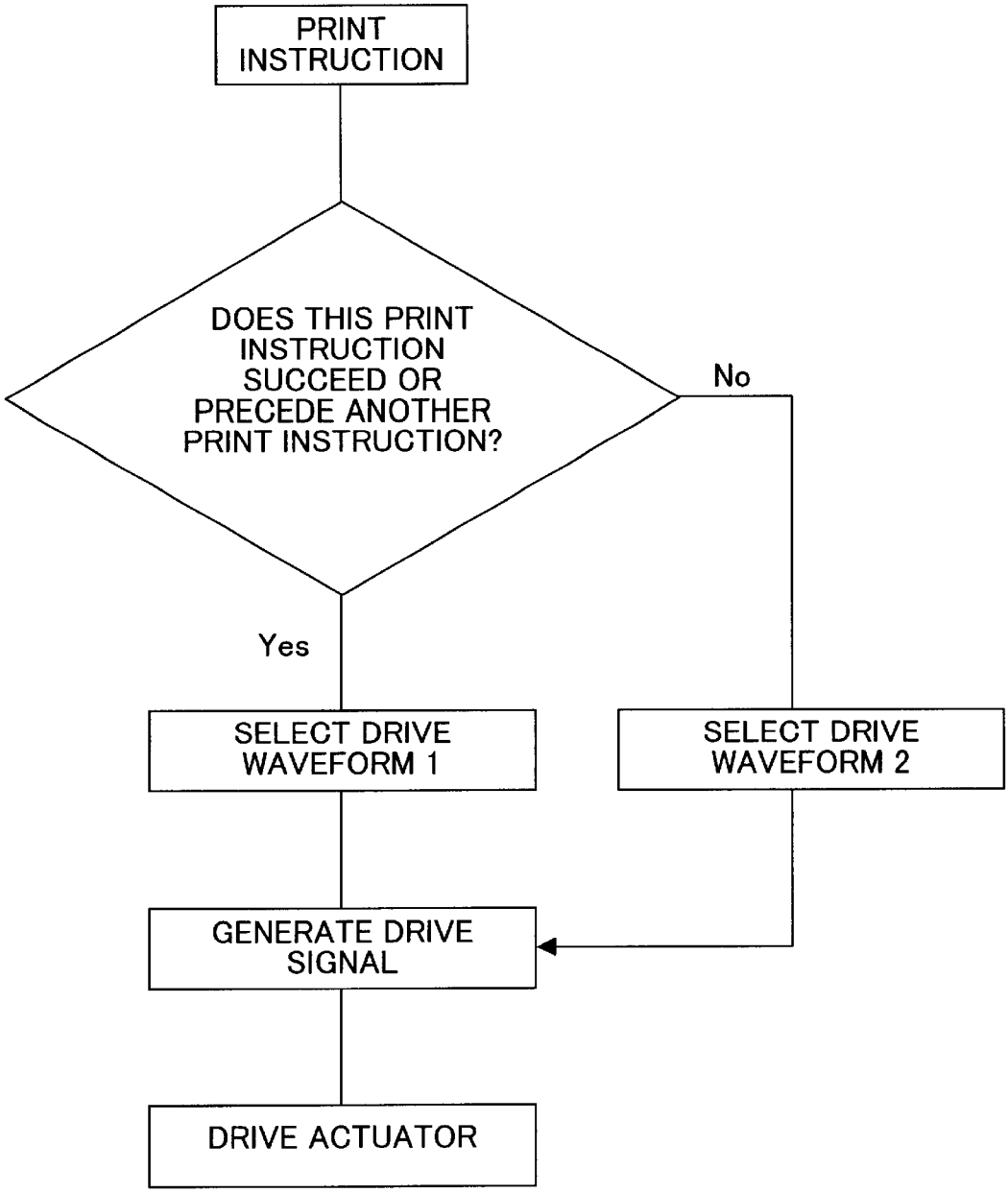
FIG. 11 is a flow chart showing an example of operation of the driver circuit.

In FIG. 10A, a print instruction is provided as a control signal from the driver software in a personal computer to the driver circuit in the driver 625. Based on the control signal, the driver circuit reads various data from the ROM 214, and generates a drive signal to drive the appropriate actuator. Stored in the driver circuit are data representing the presence or absence of a print instruction just before each dot and the type of drive waveform used for the ejection of ink droplets. Depending on whether print instructions are present or absent just before and/or just after the dot, and on the type of drive waveform used for the ejection of ink droplets, the driver circuit selectively reads the drive waveform 1 or 2 from the ROM 214 as stated above. FIG. 11 is a flow chart showing an example of operation of the driver circuit as mentioned above.

FIG. 10B shows another embodiment, in which the drive waveforms and a program for selection of one of them are stored as tables in the driver software in a personal computer. By referring to the tables, the driver software converts a print instruction into a control signal, which is supplied to the driver circuit, where the control signal is converted into a drive signal for driving the appropriate actuator. Based on the data of the tables, the driver software changes the drive waveform as stated above. The driver software is stored in a storage medium.

The present invention is not limited to the embodiments. The widths, number, combination, etc. of ejection pulses and ejection stabilization pulses of each drive waveform could be varied freely. The actuators are shear mode type actuators, but might be made of laminated piezoelectric material, which could deform in the direction of lamination to generate pressure waves. The actuators might be made of other material which could generate pressure waves in the ink channels.

As stated hereinbefore, fewer ink droplets are ejected to print a dot in accordance with one print instruction either immediately succeeding or immediately preceding no other. This prevents the ink droplets from being ejected to wrong points and needless ink droplets from being ejected, even if the ejection is liable to be affected by ink meniscus vibration in such a case that there is a print instruction for every other drive cycle.

What is claimed is:

1. An ink jet recording method for recording a dot pattern on a record medium by means of a recorder including an actuator, the actuator having an ink channel filled with ink and a nozzle communicating with the ink channel, the ink channel changing in volume to eject ink therefrom through the nozzle, the method comprising the steps of:

judging whether one print instruction for forming a dot immediately follows another or not and whether the one print instruction immediately precedes another or not; and causing the actuator to eject a predetermined number of ink droplets for forming the dot depending on the result of the judgment.

2. The recording method according to claim 1, further comprising the steps of:

selecting, as the predetermined number of ink droplets for forming the dot, a number N if the one print instruction immediately follows another and immediately precedes another, the number N being at least two ($N \leqq 2$); and selecting, as the predetermined number of ink droplets for forming the dot, a number M if the one print instruction immediately follows and immediately precedes no others, the number M being smaller than the number N ($M<N$).

3. The recording method according to claim 2, wherein when the temperature of the ink or the ambient temperature around the ink is lower than a predetermined temperature, the number N ($N \leqq 2$) is selected as the predetermined number of ink droplets if the one print instruction immediately follows or immediately precedes no other.

4. The recording method according to claim 2, wherein when the ink temperature or the ambient temperature is equal to or higher than the predetermined temperature, the number M ($M \leqq N$) is selected as the predetermined number of ink droplets, if the one print instruction immediately follows or immediately precedes no other.

5. The recording method according to claim 2, wherein the number N is three or four.

6. The recording method according to claim 5, wherein the number M is equal to $N-1$.

7. An ink jet recorder comprising:

an actuator having an ink channel adapted to be filled with ink and a nozzle communicating with the ink channel, the ink channel changing in volume to eject ink therefrom to record a dot pattern on a record medium;

a judgment device for judging whether one print instruction for forming a dot immediately follows another or not and whether the one print instruction immediately precedes another or not; and a driver for driving the actuator to eject from the actuator a predetermined number of ink droplets for forming the dot depending on a result of the judgment.

8. The recorder according to claim 7, further comprising a storage device storing therein the relationship between the predetermined number of ejected ink droplets or ejection waveform and the presence/absence of print instructions immediately preceding and immediately following the one print instruction.

9. The recorder according to claim 7, wherein the judgment device is a circuit for driving the actuator.

10. The recorder according to claim 7, wherein the driver drives the actuator to eject a number N of ink droplets which are at least two ($N \leqq 2$) if the judgment device judges that the one print instruction immediately follows another and immediately precedes another, while the driver drives the actuator to eject a number of ink droplets fewer than the number N of ink droplets ($M<N$) if the judgment device judges that the one print instruction immediately follows and immediately precedes no others.

11. The recorder according to claim 10, further comprising a temperature sensor for measuring the temperature of the ink or the ambient temperature around the ink; wherein when the measured temperature is lower than a predetermined temperature, the driver drives the actuator to eject the number N ($N \leqq 2$) of ink droplets if the one print instruction immediately follows or immediately precedes no other.

12. The recorder according to claim 10, further comprising a temperature sensor for measuring the temperature of the ink or the ambient temperature around the ink; wherein when the measured temperature is equal to or higher than the predetermined temperature, the driver drives the actuator to eject the number M ($M<N$) if the one print instruction immediately follows or immediately precedes no other.

13. The recorder according to claim 10, wherein the number N is three or four.

14. The recorder according to claim 13, wherein the number M is equal to $N-1$.

15. A storage medium storing therein a program for use with an ink jet recorder including an actuator, the actuator having an ink channel filled with ink and a nozzle communicating with the ink channel, the program being for driving the actuator so that the ink channel changes in volume to eject ink therefrom through the nozzle to record a dot pattern on a record medium, the program comprising the steps of:

judging whether one print instruction for forming a dot immediately follows another or not and whether the one print instruction immediately precedes another or not; and controlling the actuator to eject from the actuator a predetermined number of ink droplets for forming the dot depending on the result of the judgment.

16. The storage medium according to claim 15, wherein the program further comprises the steps of:

selecting, as the predetermined number of ink droplets for forming the dot, a number N if the one print instruction immediately follows another and immediately precedes another, the number N being at least two ($N \leqq 2$); and selecting, as the predetermined number of ink droplets for forming the dot, a number M if the one print instruction immediately follows and immediately precedes no others, the number M being smaller than the number N ($M<N$).

17. The storage medium according to claim 16, wherein the number N is three or four.

18. The storage medium according to claim 17, wherein the number M is equal to $N-1$.

19. The storage medium according to claim 15, wherein the program is driver software for controlling a driver circuit for the actuator.

20. The storage medium according to claim 15, and having data stored therein on different waveforms for the actuator.

21. The storage medium according to claim 15, wherein the program comprises the step of selecting, as the predetermined number of ink droplets for forming the dot, a number N if the one print instruction immediately follows or immediately precedes no other, the number N being at least two ($N \leqq 2$).

22. The storage-medium according to claim 15, wherein the program comprises the step of selecting, as the predetermined number of ink droplets for forming the dot, a number M depending on the temperature of the ink or the ambient temperature around the ink if the one print instruction immediately follows or immediately precedes no other, the number M being smaller than the number N ($M<N$).

* * * * *